US006112962A

United States Patent [19]

Matthews

[11] Patent Number: 6,112,962

[45] Date of Patent: Sep. 5, 2000

[54] HAND WEAPON HOLSTERING SYSTEMS

[75] Inventor: John Wallace Matthews, Corona del Mar, Calif.

[73] Assignee: Laser Products Ltd., Fountain Valley, Calif.

[21] Appl. No.: 08/849,566

[22] PCT Filed: Jul. 26, 1995

[86] PCT No.: PCT/US95/09471

§ 371 Date: May 27, 1997

§ 102(e) Date: May 27, 1997

[87] PCT Pub. No.: WO97/05443

PCT Pub. Date: Feb. 13, 1997

[51] Int. Cl.[7] ..... A45F 3/00

[52] U.S. Cl. ..... 224/243; 224/191; 224/192; 224/193; 224/242; 224/245; 224/912

[58] Field of Search ..... 224/192, 193, 224/242–245, 232, 271, 272, 670, 911, 912, 191; 42/100, 103

[56] References Cited

U.S. PATENT DOCUMENTS

| | | | |
|---|---|---|---|
| 1,166,781 | 1/1916 | Parrish . | |
| 1,430,081 | 9/1922 | Holler . | |
| 1,641,439 | 9/1927 | Jovino | 224/244 |
| 2,551,913 | 8/1951 | Toby | 224/2 |
| 2,765,107 | 10/1956 | Browning | 224/2 |
| 3,642,184 | 2/1972 | Hendricks | 224/2 C |
| 3,910,469 | 10/1975 | Baldocchi | 224/271 |
| 4,121,743 | 10/1978 | Burton | 224/269 |
| 4,383,371 | 5/1983 | Coffey | 33/245 |
| 4,777,754 | 10/1988 | Reynolds | 42/103 |
| 5,127,566 | 7/1992 | Beletsky | 224/243 |
| 5,150,825 | 9/1992 | Nichols | 224/243 |
| 5,199,620 | 4/1993 | Beletsky | 224/243 |
| 5,208,826 | 5/1993 | Kelly | 372/107 |
| 5,215,238 | 6/1993 | Baruch | 224/243 |
| 5,269,448 | 12/1993 | Shoemaker | 224/243 |
| 5,275,317 | 1/1994 | Rogers et al. | 224/244 |
| 5,282,559 | 2/1994 | Wisser et al. | 224/243 |
| 5,284,281 | 2/1994 | Nichols | 224/244 |
| 5,358,160 | 10/1994 | Bianchi | 224/244 |
| 5,395,021 | 3/1995 | Brown | 224/244 |
| 5,421,497 | 6/1995 | Gilmore | 224/198 |
| 5,467,909 | 11/1995 | Resca | 224/244 |
| 5,598,958 | 2/1997 | Ryan, III et al. | 224/198 |
| 5,630,535 | 5/1997 | Valenti | 224/271 |
| 5,671,561 | 9/1997 | Johnson et al. | 42/103 |
| 5,758,448 | 6/1998 | Thummel | 42/103 |
| 5,794,347 | 8/1998 | Serpa | 224/232 |

*Primary Examiner*—David J. Walczak
*Assistant Examiner*—Timothy L. Maust
*Attorney, Agent, or Firm*—Benoit Law Corporation

[57] ABSTRACT

Holstering systems for hand weapons comprise a track structure provided as a holster for such hand weapons. Each hand weapon may be provided with an adapter complementary with the track structure. The holster may be a standard holster for different types of elongate hand weapons that may have adapters interfacing with such standard holster. Such holsters may have an accommodation for accessories. Security holsters prevent accidental and unauthorized removal of weapons from holsters, such as with the aid of detents, sensors of a hand of a wearer, or other detent deactivators.

70 Claims, 5 Drawing Sheets

HAND WEAPON HOLSTERING SYSTEMS

FIELD OF THE INVENTION

This is the National Phase of International Application PCT/US95/09471, filed on Jul. 26, 1995 by Laser Products Corporation, the Assignee of the entire interest hereof, as International applicant, and by the subject inventor.

The subject invention relates to holstering systems for handguns and other hand weapons, including security holsters that prevent accidental and unauthorized removal of weapons from holsters and that permit weapons with attachments to be holstered.

BACKGROUND

The use of holsters for hand weapons goes back to prehistoric times, when hunters started to use quivers for their arrows. Even the use of holsters for handguns is almost as old as handguns themselves.

More recent effort have concentrated on the development of security holsters.

By way of example, the following patents present descriptions of related background developments.

In particular, U.S. Pat. No. 5,127,566, by Robert J. Beletsky, issued Jul. 7, 1992 for Security Holster Thumb-Break, discloses an assembly for releasably securing a holster safety strap. A dual position thumb break prevents removal of the pistol unless the open position is selected.

U.S. Pat. No. 5,150,825, by Richard E. D. Nichols, issued Sep. 29, 1992 for Holster with Retention Device, discloses a holster having a retention device for applying pressure to a handgun in the holster to resist inadvertent removal of the handgun. An elongate band prevents removal of the pistol when force is applied.

U.S. Pat. No. 5,199,620, by Robert J. Beletsky, issued Apr. 6, 1993 for Security Holster Thumb-Break, discloses another assembly for releasably securing a holster safety strap, including a thumb break with directional release to open the holster.

U.S. Pat. No. 5,215,238, by Alan Baruch, issued Jun. 1, 1993 for a Holster for a Weapon with Laser Light capable of accommodating a pistol with attached laser light and including a safety retention.

U.S. Pat. No. 5,269,448, by Randy R. Shoemaker, issued Dec. 14, 1993 for a Front Draw Handgun Holster whose side wall portions are adjustable toward one another to prevent a handgun from falling from the holster and from being grabbed by an attacker, and adjustable away from one another to release the gun for fast front draw as well as upward removal from the holster. The holster is angularly adjustable relative to the wearer's body. U.S. Pat. No. 5,275,317, by William H. Rogers and Norman E. Clifton, Jr., issued Jan. 4, 1994 for a Handgun Holster with a Lockable Trigger Guard Restraint. Such holster has a rigid body portion and two upwardly extending oppositely facing wall members forming a channel therebetween to receive a handgun trigger guard, a pivotable cam member in at least one wall member and locking means engageable with the cam to prevent it from being pivoted and a finger operable member to unlock the locking means. According to that patent, the holster disclosed therein preferably is made of a moldable leather/plastic laminate which is processed to have the unique contours to receive a selected handgun and is not suitable as a holster for any other gun shape.

U.S. Pat. No. 5,282,559, by Glen Wisser et al., issued Feb. 1, 1994 for a Holster with Frame, and discloses anti-twist plates for resisting unauthorized removal of a handgun from the holster, and a security strap and thumb-break attached to the frame of the holster.

U.S. Pat. No. 5,284,281, by Richard E. D. Nichols, issued Feb. 8, 1994 for a Holster with Trigger Guard Gripping Device having at least one projection for extending into the trigger guard of a handgun, and being moveable with the gun between a first position in which the projection is rigidly held in the trigger guard and a second position in which the projection is only loosely biased into the trigger guard so that it can be released by simply pulling the handgun away from the gripping device.

U.S. Pat. No. 5,395,021, by Alvah B. Brown, issued Mar. 7, 1995 for a Handgun Holster and Retention Block Therefor discloses a spring biased trigger guard latch that reduces the possibility of unauthorized release and that is located under the sheath material of the holster to conceal it from view.

Drawbacks of such prior-art proposals include impediment of fast draws of handguns through the presence of thumb breaks or other safety devices that need to be actuated by the legitimate user of the weapon, need of extensive training for intended users in the case of complex holstering systems, and lack of accommodation of accessories without provision of special holster pockets therefor.

SUMMARY OF THE INVENTION

From a first aspect thereof, the invention resides in a method of holstering an elongate hand weapon and, more specifically, resides in the improvement comprising, in combination, making a track structure, forming that track structure as a holstering device for the elongate hand weapon, and equipping the elongate hand weapon with an adapter equipping complementary with the track structure for holstering that adaptor in that track structure while holstering the elongate hand weapon in the holstering device and making that adapter integral with that elongate hand weapon as distinguished from the holstering device, so that that adapter is removed with that elongate hand weapon from the holstering device when that hand weapon is drawn from that holstering device, and equipping the holstering device and the adapter with a detent releasably retaining that adapter at the track structure.

From another aspect thereof, the invention resides in a method of holstering an elongate hand weapon in a holstering device having a track structure and, more specifically, resides in the improvement comprising, equipping the elongate hand weapon with an adapter complementary with the track structure for holstering the an adapter in that track structure while holstering the elongate hand weapon in the holstering device and making that adapter integral with that elongate hand weapon as distinguished from the holstering device, so that that adapter is removed with that elongate hand weapon from the holstering device when that hand weapon is drawn from that holstering device, and equipping the holstering device and the adapter with a detent releasably retaining that adapter at the track structure.

From another aspect thereof, the invention resides in a method of holstering an elongate hand weapon having an adapter for holstering that elongate hand weapon in a holstering device and having an accessory exteriorily attached to and part of the hand weapon, and, more specifically, resides in the improvement comprising, in combination, equipping the holstering device with a track structure complementary with the adapter for holstering that slide structure in that track structure while holstering the elongate hand weapon in the holstering device; the adapter being integral with that elongate hand weapon as distinguished from the holstering device, so that that adapter is removed with that elongate hand weapon from the holstering device when that hand weapon is drawn from that holstering device, and equipping the holstering device with an accommodation for the accessory.

From another aspect thereof, the invention resides in a method of holstering any one of a number of different types of elongate hand weapons and, more specifically, resides in the improvement comprising, in combination, making a standard holstering device for the different types of elongate hand weapons, and equipping each of the different types of elongate hand weapons with an adapter interfacing with the standard holstering device for the different types of elongate hand weapons, making each adapter integral with that elongate hand weapon as distinguished from the holstering device, so that that adapter is removed with that elongate hand weapon from the holstering device when that hand weapon is drawn from that holstering device, and equipping the standard holstering device and each adapter with a detent releasably retaining each adapter.

From another aspect thereof, the invention resides in a method of holstering an elongate hand weapon and, more specifically, resides in the improvement comprising, in combination, making a holstering device, holstering the hand weapon in the holstering device, equipping the elongate hand weapon and the holstering device with a normally deactivated detent for selectively retaining said hand weapon in that holstering device, drawing the hand weapon from the holstering device with a hand having an outstretched finger, and blocking removal of the hand weapon from the holstering device upon attempts to remove the hand weapon from the holstering device without the hand having the outstretched finger substantially parallel to the elongate hand weapon by activating the detent only upon attempts to remove the hand weapon from the holstering device without the hand having the outstretched finger substantially parallel to the elongate hand weapon.

From another aspect thereof, the invention resides in apparatus for holstering an elongate hand weapon and, more specifically, resides in the improvement comprising, in combination, a track structure, a holstering device for the elongate hand weapon including that track structure, and a adapter for the elongate hand weapon complementary with that track structure and removable with the elongate hand weapon from the holstering device, such adapter being integral with the elongate hand weapon as distinguished from the holstering device, so that such adapter is removed with the elongate hand weapon from the holstering device when that hand weapon is drawn from that holstering device. This apparatus includes a detent adapted to releasably retain the adapter at the track structure until a wearer of the holstered hand weapon pulls such hand weapon from the holstering device.

From another aspect thereof, the invention resides in apparatus for holstering an elongate hand weapon in a holstering device including a track structure and, more specifically, resides in the improvement comprising an adapter for the elongate hand weapon complementary with the track structure and removable with the elongate hand weapon from the holstering device, such adapter being integral with the elongate hand weapon as distinguished from the holstering device, so that such adapter is removed with the elongate hand weapon from the holstering device when that hand weapon is drawn from the holstering device. This apparatus includes a detent adapted to releasably retain the adapter at the track structure until a wearer of the holstered hand weapon pulls the hand weapon from the holstering device.

From another aspect thereof, the invention resides in apparatus for holstering an elongate hand weapon having structure for the elongate hand weapon and, more specifically, resides in the improvement comprising, in combination, a track structure complementary with the adapter, and a holstering device for the elongate hand weapon including that track structure; the slide structure being removable with the elongate weapon from the holstering device, that slide structure being integral with that elongate hand weapon as distinguished from the holstering device, so that that slide structure is removed with that elongate hand weapon from the holstering device when that hand weapon is drawn from that holstering device. The adapter is removable with the elongate hand weapon from the holstering device, and is integral with the elongate hand weapon as distinguished from the holstering device, so that such adapter is removed with the elongate hand weapon from the holstering device when the hand weapon is drawn from the holstering device. This apparatus includes a detent adapted to releasably retain the adapter at the track structure until a wearer of the holstered hand weapon pulls such hand weapon from the holstering device.

From another aspect thereof, the invention resides in apparatus of holstering any one of a number of different types of elongate hand weapons and, more specifically, resides in the improvement comprising, in combination, a standard holstering device for the different types of elongate hand weapons, and for each of the different types of elongate hand weapons an adapter interfacing with the standard holstering device for the different types of elongate hand weapons and removable with the elongate hand weapon from the holstering device, each adapter being integral with a corresponding elongate hand weapon as distinguished from the holstering device, so that that adapter is removed with that elongate hand weapon from that holstering device when that hand weapon is drawn from that holstering device. This apparatus includes a track structure in the standard holstering device with each adapter being complementary with that track structure in that standard holstering device. This apparatus further includes a detent adapted to releasably retain the adapter at the track structure until a wearer of the holstered hand weapon pulls the hand weapon from the holstering device.

From another aspect thereof, the invention resides in apparatus for holstering an elongate hand weapon and, more specifically, resides in the improvement comprising, in combination, a holstering device for the hand weapon, and a normally deactivated detent adapted to block removal of the hand weapon from the holstering device by selectively retaining said hand weapon in the holstering device, and a detent activator adapted to activate the detent only upon attempts to remove the hand weapon from the holstering device without a hand having a finger outstretched substantially parallel to the elongate hand weapon.

From yet another aspect thereof, the invention resides in a method of holstering an elongate hand weapon in a holstering device having a track structure, and, more specifically, resides in the improvement comprising, in combination, equipping that elongate hand weapon with a slide structure complementary with the track structure for holstering such slide structure in that track structure while holstering the elongate hand weapon in the holstering device, making the slide structure integral with the elongate hand weapon as distinguished from the holstering device, so that the slide structure is removed with the elongate hand weapon from the holstering device when that hand weapon is drawn from the holstering device, equipping the holstering device and the slide structure with a detent for releasably retaining that slide structure at the track structure against removal of the holstered hand weapon from the holstering device; that detent being deactivated as long as the hand weapon is in the holstering device, that detent remaining deactivated by presence of part of a hand of a wearer drawing the hand weapon from the holstering device, and the detent becoming activated for retaining the hand weapon in the holstering device upon attempts to remove that hand weapon from the holstering device in the absence of the mentioned part of a hand of a wearer drawing that hand weapon.

From a related aspect thereof, the invention resides in apparatus for holstering an elongate hand weapon in a holstering device including a track structure, and, more specifically, resides in the improvement comprising, in combination, a slide structure for that elongate hand weapon complementary with the track structure and removable with that elongate hand weapon from the holstering device; that slide structure being integral with the elongate hand weapon as distinguished from the holstering device, so that such slide structure is removed with the elongate hand weapon from the holstering device when that hand weapon is drawn from that holstering device, a detent adapted to releasably retain the slide structure at the track structure against removal of the holstered hand weapon from the holstering device, a first detent deactivator adapted to deactivate the detent as long as the hand weapon is in the holstering device, a second detent deactivator adapted to deactivate the detent in response to a presence of part of a hand of a wearer drawing the hand weapon from the holstering device, and a detent activator adapted to activate the detent for retaining the hand weapon in the holstering device upon attempts to remove that hand weapon from that holstering device in the absence of the mentioned part of a hand of a wearer drawing that hand weapon.

From a related aspect thereof, the invention resides in apparatus for holstering an elongate hand weapon in a holstering device including a track structure, and, more specifically, resides in the improvement comprising, in combination, a slide structure for that elongate hand weapon complementary with the track structure and removable with that elongate hand weapon from the holstering device; that slide structure being integral with the elongate hand weapon as distinguished from the holstering device, so that such slide structure is removed with the elongate hand weapon from the holstering device when that hand weapon is drawn from that holstering device; that holstering device including an angularly moveable portion and a relatively stationary portion; the track structure being on that angularly moveable portion, and a detent on the relatively stationary portion being positioned to engage the slide structure when the hand weapon is in the holstering device prior to angular movement of the angularly moveable portion relative to the stationary portion.

No recitation in any description herein or claim hereof is intended to be limited to any recited sequence of steps, features or other elements.

Recitation of any combination of steps, features or elements in any preamble of any claim hereof is not intended as a representation or concession that such combination is prior art.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

Figures 1, 1A:
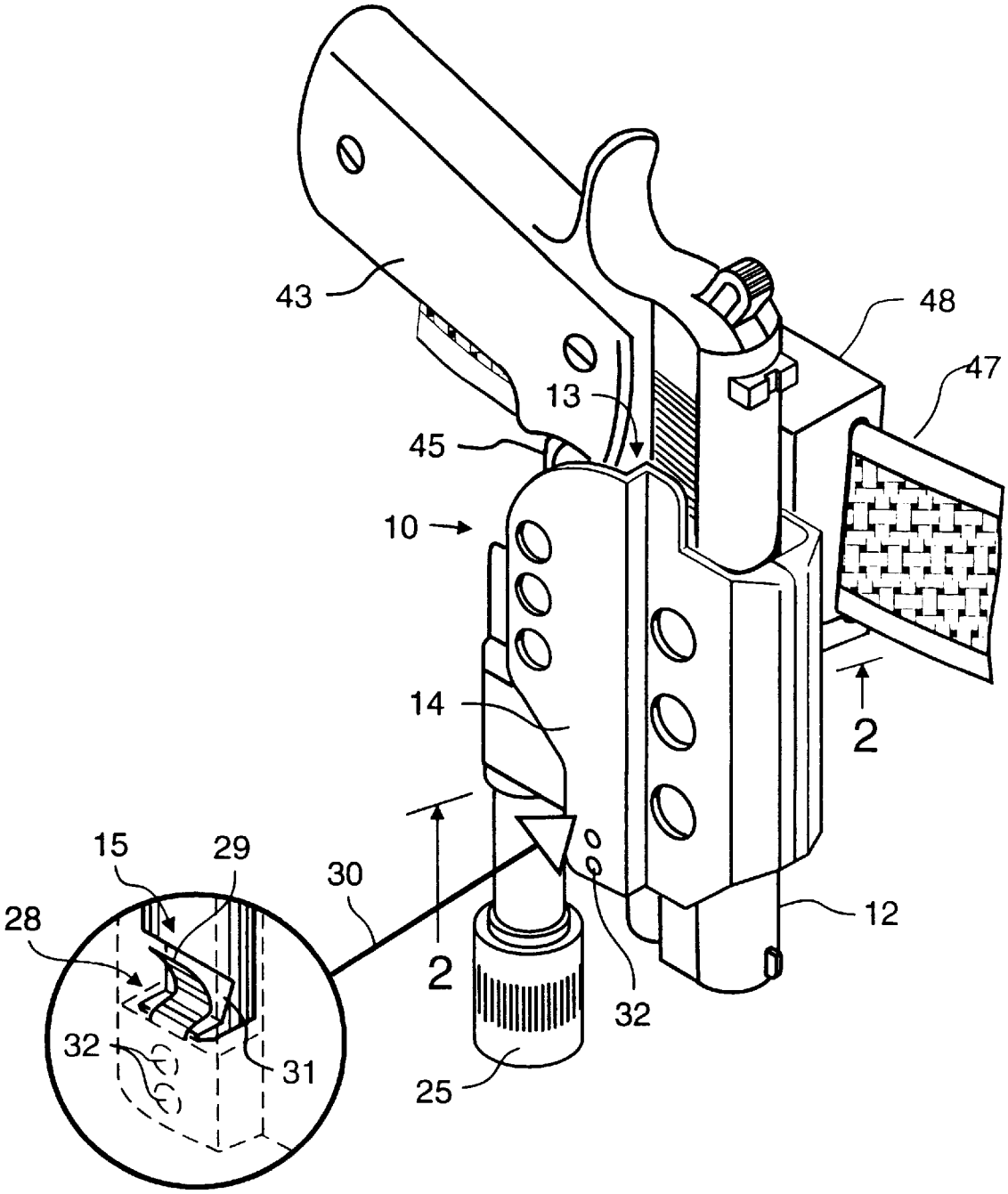
FIG. 1 is a perspective view of a hand weapon holstering system according to an embodiment of the invention.
FIG. 1A is a detail view, on an enlarged scale, of a detent that may be implemented in the holstering systems herein disclosed according to an embodiment of the invention.

The drawings illustrate and show methods and apparatus 10 for holstering handguns or other elongate hand weapons 12 according to embodiments of the invention. Such methods and apparatus provide or comprise a track structure 13 which is provided as a holstering device 14 for the elongate hand weapon 12. In apparatus terms, holstering devices 14 for elongate hand weapons 12 include the track structure 13.

Also according to an embodiment of the invention, such elongate hand weapon is provided with or comprises a slide structure or adapter 15 which is or is made complementary with the track structure or adapter 13 for holstering the slide structure 15 in that track structure, while holstering the elongate hand weapon 12 in its holstering device 14. This may also be expressed by saying that the track structure 13 is or is made complementary with the slide structure or adapter 15 for holstering such slide structure or adapter 15 in that track structure, while holstering the elongate hand weapon 12 in its holstering device 14. In this respect the drawings, such as FIGS. 2, 2A, 2B, 2C, 4 and 8, show that the slide structure or adapter 15 is integral with the elongate hand weapon 12 as distinguished from the holstering device 14, so that such slide structure is removed with that elongate hand weapon from that holstering device 14 when that hand weapon is drawn from such holstering device such as seen in FIG. 4 and again in FIG. 7.

Embodiments of the invention extend not only to such combinations, but also to methods and apparatus for holstering an elongate hand weapon 12 in a holstering device 14 having a track structure 13, which reside in the improvement of providing such elongate hand weapon with a slide structure or adapter 15 complementary with the track structure or adapter 13 for holstering such slide structure in that track structure while holstering the elongate hand weapon in the holstering device 14.

Conversely, embodiments of the invention reside in methods and apparatus for holstering an elongate hand weapon 12 having a slide structure or adapter 15 for holstering such elongate hand weapon in a holstering device 14, which reside in the improvement of providing such holstering device with a track structure 13 complementary with the slide structure or adapter 15 for holstering that slide structure or adapter in the track structure while holstering the elongate hand weapon in the holstering device 14.

Pursuant to a preferred embodiment of the invention, the track structure 13 is provided with or includes two tracks 16 and 17 in the holstering device 14, and the slide structure or adapter 15 is provided with or includes two slides 18 and 19 complementary with those two tracks in the holstering device.

According to a related embodiment of the invention, the track structure or adapter 13 and slide structure 15 are provided as or comprise a tongue and groove combination, including a tongue structure, such as shown at 16 and 17, and a groove structure, such as shown at 18 and 19. Within the scope of the invention, such tongue structure, while shown as part of the track structure 13, could be on the slide structure or adapter 15, while the groove structure or adapter, while shown in such slide structure, could be in the track structure instead. In this respect, the drawings show the slide structure or adapter 15 with lateral tongues 21 and 22, and the track structure with corresponding grooves 23 and 24. Accordingly, the tongue and groove combination may include a tongue structure, such as shown at 16, 17, 21 or 22, as one of the track structure and slide structure or adapter, and a groove structure, such as shown at 18, 19, 23 or 24, as the other of the track structure and slide structure.

Figure 2:
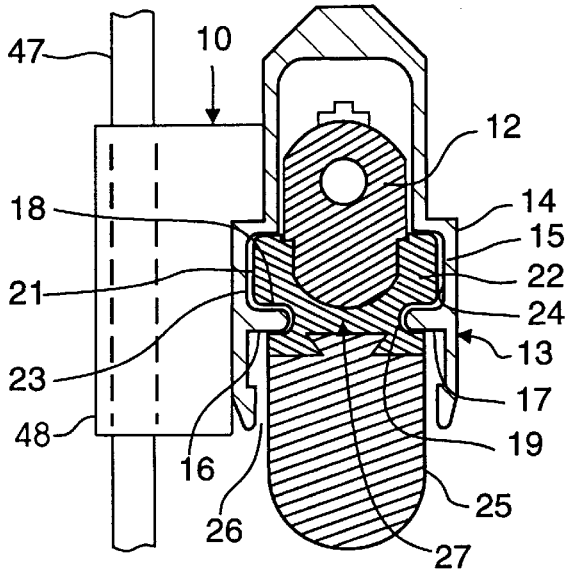
FIG. 2 is a section taken approximately on the line 2—2 in FIG. 1, and together with FIGS. 2A to 2C shows a standard holstering device for different types of weapons.
Figure 4:
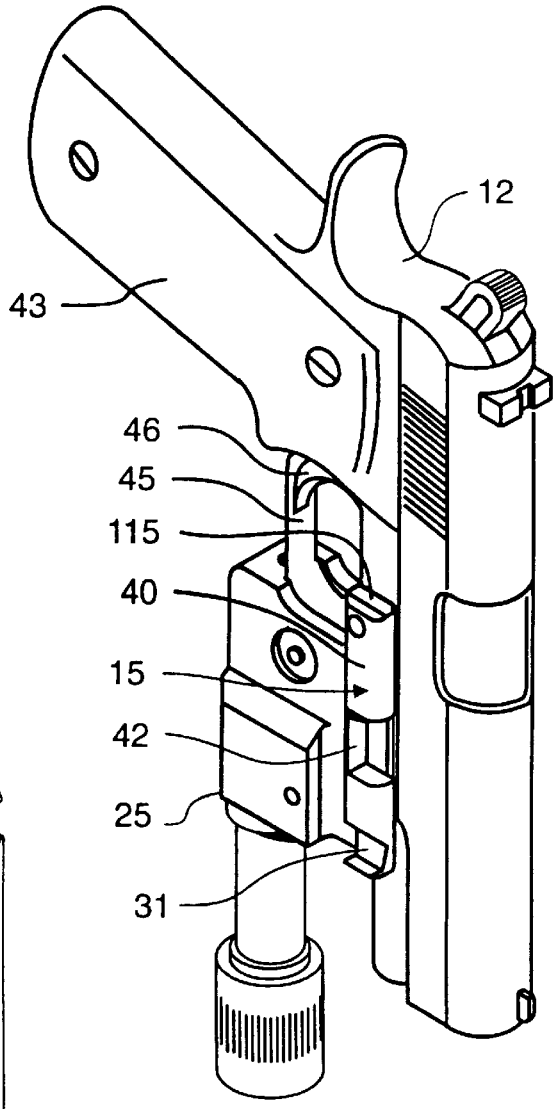
FIG. 4 is a perspective view of a hand weapon with holstering adapter according to an embodiment of the invention.
Figure 5:
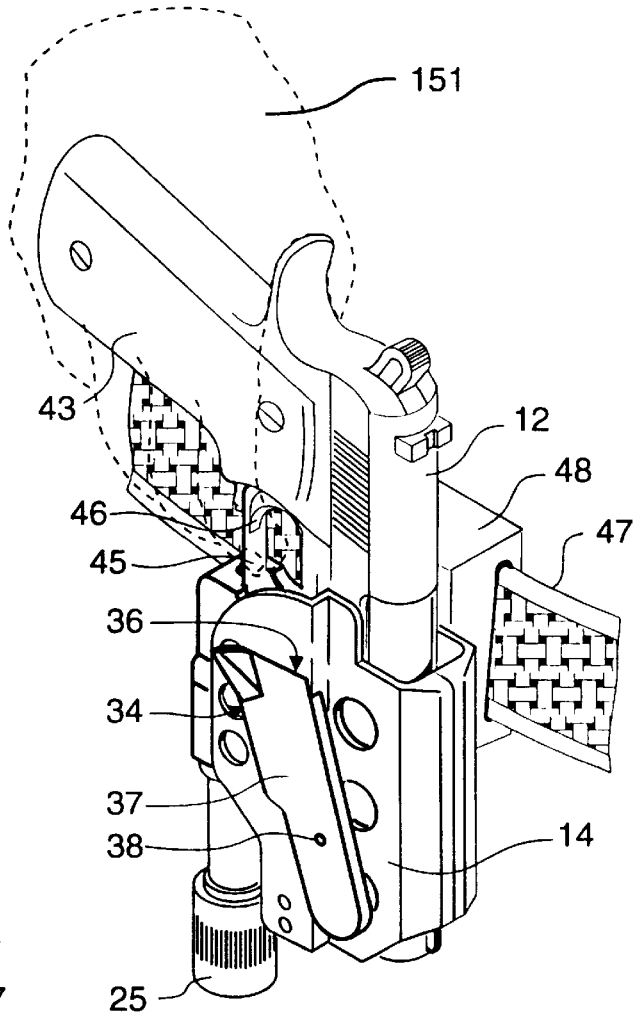
FIG. 5 is a perspective view of a holstering system according to a further embodiment of the invention, showing the hand weapon half drawn from the holster, such as by an assailant.

For hand weapons having an accessory 25 exteriorly attached or otherwise exterior to, but part of such hand weapon, the holstering device 14, according to an embodiment of the invention, is provided with an accommodation for such accessory. Such accommodation may include an elongate opening 26 in the holstering device 14, extending along the track structure 13 or the tracks 16 and 17 or the tongues 16 and 17. By way of example, FIGS. 4 and 5 show a target illumination light or lamp as the accessory 25. Other examples include a laser light, such as in the above mentioned U.S. Pat. No. 5,215,238 or otherwise, and various auxiliary gun sights, pepper spray and mace containers, knives or bayonets, high-voltage or stunning devices, etc. etc., all symbolized in FIG. 2 by an attachable accessory part 25. In this respect, FIG. 2 shows such accessory 25 attached to the slide structure or adapter 15 by a dovetail structure 27. Within the scope of the invention, a bayonet socket or any other mount for an accessory 25 for the hand weapon 12 may be provided at 27 as part of the hand weapon.

According to an embodiment of the invention, the holstering device 14 is open along one side thereof, typically the rear side, such as seen at 26 in FIGS. 2, 2A to C, and 3.

The overall goal of prior-art effort has been to provide each holster for a specific hand weapon. The above mentioned U.S. Pat. No. 5,275,317 typifies such prior-art goal by stating that its holster preferably is made "to have the unique contours to receive a selected handgun 20 and is not suitable as a holster for any other gun shape."

While holstering devices of the subject invention, indeed, may be made to receive only a specific hand weapon or handgun, preferred embodiments of the invention provide methods and apparatus for holstering any one of a number of different types of elongate hand weapons. Such methods provide a standard holstering device for such number of different types of elongate hand weapons, and provide each of such elongate hand weapon with an adapter interfacing with such standard holstering device 14 for elongate hand weapons. By way of example, the slide structure 15 may serve as such adapter.

Where the standard holstering device 14 is provided with or has a track structure 13, each adapter is a slide structure 15 complementary with that track structure in that standard holstering device. By way of example, where the track structure 13 is provided with two tracks 16 and 17 in the standard holstering device 14, each slide structure or adapter 15 is provided with two slides 18 and 19 complementary with these two tracks in the standard holstering device.

Figure 2A:
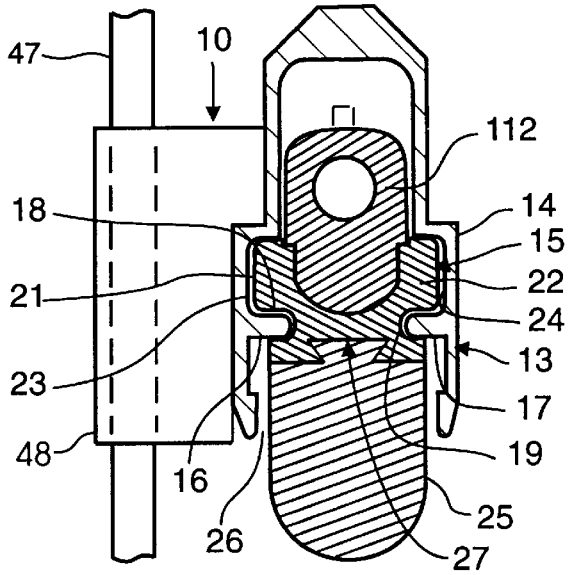
Figure 2B:
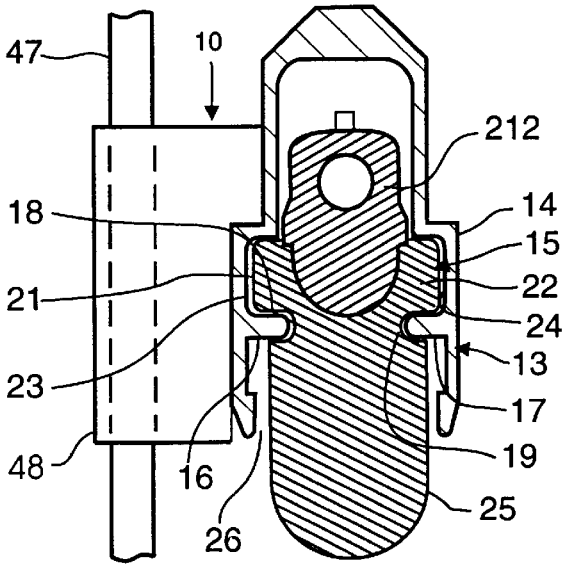
Figure 2C:
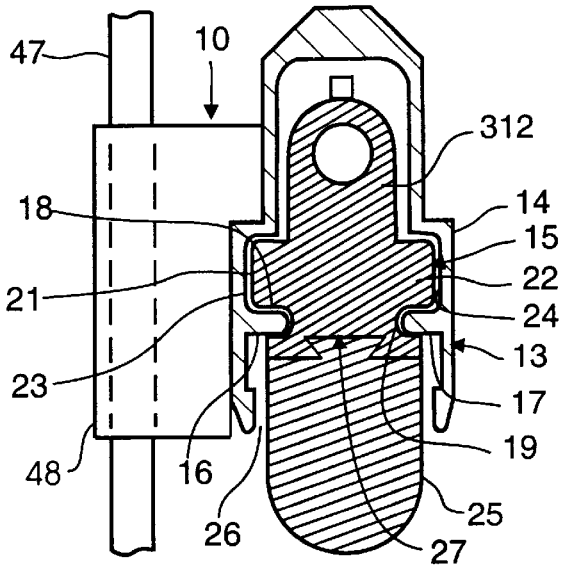
Figure 3:
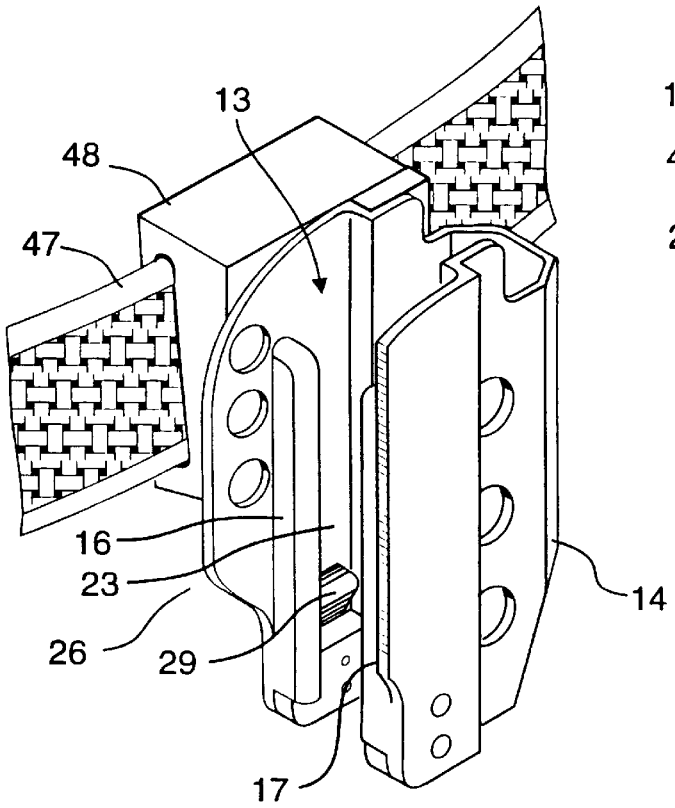
FIG. 3 is a perspective view similar to FIG. 1 but showing the holstering structure without the hand weapon, with an edge broken away for better visibility of the track structure.

FIGS. 2 and 2A to C illustrate an embodiment of this principle. By way of example, FIGS. 2A, 2B and 2C show different types of hand weapons 112, 212 and 312. According to the embodiment of the invention illustrated in FIGS. 2 and 2A to 2C, all these different types of weapons 12, 112, 212, 312 are capable of being holstered in the same standard holstering device 14; typically one at a time. Each of the weapons 12, 112, 212 and 312 has an adapter 15 interfacing with the standard holstering device for such weapons 12, 112, 212 and 312. While such adapter may be the above mentioned slide structure 15, the adapters for the different types of weapons 12, 112, 212, 312 need not be identical within the scope of the invention. By way of example, the adapter for the weapon 112 may be different from the adapter for the weapon 12, and so forth, as long as all adapters interface with the standard holstering device 14.

Within the scope of the invention, any slide structure or adapter 15 may be manufactured separately from the hand weapon and may be attached or retrofitted to such weapon, or may be provided as part of any of the weapons during manufacture of such weapon or weapons.

However, the slide or adapter structures 15 of the different types of weapons 12, 112, 212, 312 all have to have some configuration that is complementary with essentials of the holstering device 14.

The holstering device 14 is the same for all of the different types of weapons 12, 112, 212, 312. Where such holstering device has a track structure 13 comprising one or more rails or tracks 16 or 17, adapters 15 will have a corresponding structure, such as shown at 18 and 19. Similarly, where such holstering device has a track structure 13 comprising one or more grooves 23 or 24, adapters 15 will have a corresponding structure, such as shown at 21 and 22.

In this respect, if the track structure 13 of the holstering device 14 has one or more rails or tracks 16 or 17, as well as one or more grooves 23 or 24, then the adapters for the different types of weapons may for instance all be configured with one or more groove structures 18 and 19 and with one or more tongue structures 21 and 22, or adapters for some of the weapons 12, 112, 212, 312 may be provided with one or more groove structures 18 and 19, while other adapters for these different types of weapons may be provided one or more tongue structures 21 and 22 instead of groove structures, with all such different adapters fitting into the same standard holster 14 for a holstering of all such different types of weapons.

So far, handguns have been mentioned as hand weapons. However, there are other hand weapons within the scope of the invention, including pepper spray and mace containers, knives or bayonets, intense light sources, high-voltage or stunning devices, etc. etc., that can be holstered by a holstering device 14 standard for different ones of such weapons.

According to embodiments of the invention, the track structure or adapter and the slide structure are provided with or include a detent 28, 33 or 54 for releasably retaining or adapted to releasably retain such slide structure or adapter 15 at the track structure 13. In this manner, the hand weapon 12 is secure against falling out of the holstering device 14, such as when the wearer rolls over or carries out some jumping motion or engages in similar action.

By way of example, FIG. 1*a* shows a latching device or latch 29 which is provided in the holstering structure 14, such as indicated by the arrow 30 in FIGS. 1 and 1*a*. The detent 28 also has a notch 31 in the slide structure or adapter 15 that corresponds with the latch 29. That latch may, for instance, be a leaf spring that is attached to the holstering device 14, such as by rivets 32, and that engages or is engaged by the slide structure or adapter 15 at its notch 31 when the hand weapon 12 is holstered in its holster 14.

Some applications and situations require greater safety against loss or removal of the weapon from its holster. Law enforcement and military personnel, for instance, are often exposed to situations in which law breakers or attackers attempt to take away, or even have succeeded in taking away, the hand weapon from its holster, frequently with the intent of injuring its wearer or of committing another crime or assault with the wrested away hand weapon.

Accordingly, a preferred embodiment of the invention provides the holstering device and slide structure or adapter with a detent 33 or 54 which releasably retains or which is adapted to releasably retain the slide structure or adapter 15 at the track structure 13 until a wearer of the holstered hand weapon 12 pulls that hand weapon from the holstering device or, in other words, until the holstered hand weapon is pulled from its holstering device 14 by the wearer of that holstering device.

Figure 7:
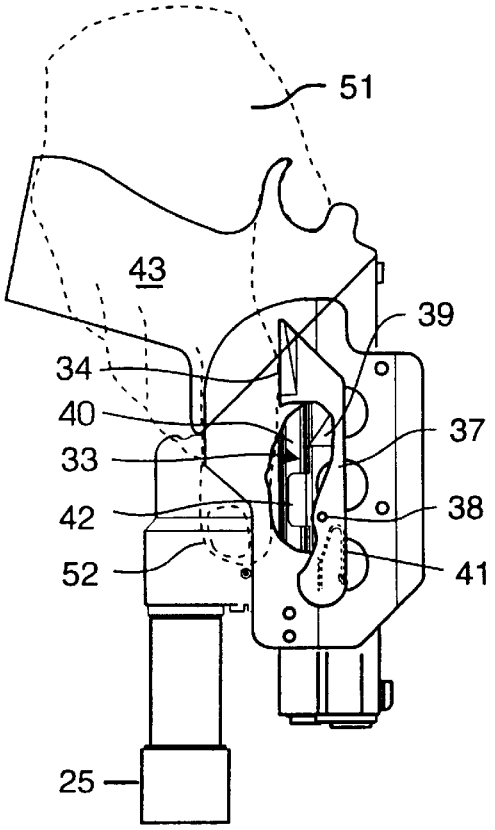
FIG. 7 is a detail view similar to FIG. 6, showing the normally unlatched holstered condition of the hand weapon of FIG. 5, and indicating a normal draw of the hand weapon by the hand of the wearer of the holstered hand weapon.
Figure 6:
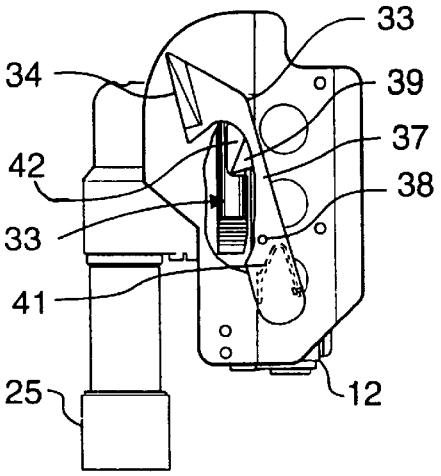
FIG. 6 is a side view of the holster region of FIG. 5, with parts broken away to show a safety mechanism of the holstering structure of FIG. 5 in action.

A preferred embodiment of the invention, such as shown in FIGS. 5 to 7, provides the track structure 13 or other part of the holstering device 14, and the slide structure or adapter 15 with a detent 33 for releasably retaining such slide structure or adapter at that track structure against removal of the holstered hand weapon 12 from its holstering device 14, and, more specifically, provides such detent with a device 34 for sensing a presence of a part of a hand 51 of a wearer of the holstered hand weapon at a predetermined location at that holstering device 14 and deactivates that detent in response to such presence of that part of the hand 51 at that predetermined location 36.

By way of example, the wearer-hand-sensing device 34 includes a lever 37 that is pivoted, such as at 38. The lever 37 carries or is coupled to a latching device or latch 39 that is biased against the slide or adapter structure 15 on the hand weapon 12, such as by a spring 41. In addition to such latch 39, the detent 33 includes a notch 42 in the slide structure 15 that corresponds to the latch 39.

Within the scope of the invention, the biased latch 39 may engage the slide structure or adapter 15 at its notch 42 when the hand weapon is holstered in its holster 14. An assailant thus would be prevented from pulling the hand weapon 12 from its holster 14, as such assailant would have to move the lever 37 effectively while pulling the hand weapon 12 out of its holster 14, all against the will and the resistance of the wearer of the hand weapon.

On the other hand, if the wearer of the holstered hand weapon intends to draw such hand weapon 12 from its holster 14, then such wearer grips the handle or stock 43 of the hand weapon with one hand 51, such as the "gun hand" in the case of a handgun. Simultaneously, the wearer places the side of that one hand 51 along the index finger or trigger finger 52 against the hand sensor 34, thereby pushing or angularly moving the lever 37 about its pivot 38 until the latch 39 is disengaged from the notch 42 in the slide or adapter structure 15. This enables the wearer to draw the weapon 12 without fumbling with leather straps or other prior-art security device which impede a fast draw and thereby impair the value of the weapon and the safety of its user.

A preferred embodiment of the invention even relieves the wearer from any conscious action as far as the safety against unauthorized or violent removal of the weapon from its holster is concerned.

In this respect, FIG. 7 shows a preferred embodiment according to which the latch 39 rest on an unnotched portion 40 of the slide or adapter structure 15 when the weapon 12 is fully inserted in its holster 14.

In this preferred embodiment of the invention, gripping the weapon 12 at its handle or grip 43 automatically prevents the security system 33 from locking the weapon in its holster. The marksman or authorized user can draw the weapon 12 as fast as if no safety 33 were present, with the latch 39 clearing the slide or adapter 15 including its notch 42 all the way, as the side of the user's hand 51 along the index finger or trigger finger 52 slides along the lever 37 at its hand sensor portion 34.

This preferred embodiment of the invention requires no action by the weapon user or shooter other than what shooters always have done in drawing a handgun; namely having the trigger finger 52 outstretched downward outside the holster during the draw for insertion of that trigger finger into the trigger guard area 45 as that trigger finger is bent for actuation of the trigger 46 and possible firing of the weapon.

In this respect and in general, an aspect of the invention resides in a method of holstering an elongate hand weapon 12 and, more specifically, resides in the improvement of providing a holstering device 14, holstering the hand weapon in that holstering device, drawing the hand weapon from that holstering device with a hand 51 having an outstretched finger 52, and blocking removal of the hand weapon from the holstering device upon attempts to remove the hand weapon from the holstering device without the hand having the outstretched finger 52.

An embodiment of the invention provides a method which includes providing the elongate hand weapon 12 and the holstering device 14 with a normally deactivated detent 33 or 39 and 42 at 15 for selectively retaining the hand weapon in the holstering device, and activating such detent only upon attempts to remove the hand weapon from the holstering device without the hand 51 having the outstretched finger 52.

Apparatus within the scope of the currently disclosed aspect of the invention for holstering an elongate hand weapon 12, comprise a holstering device 14 for such hand weapon, and a detent 33 or 39 and 42 at 15 adapted to block removal of the hand weapon from the holstering device upon attempts to remove such hand weapon from that holstering device without a hand 51 having a finger 52 outstretched substantially parallel to the elongate hand weapon 12.

According to the preferred embodiment illustrated in FIGS. 5 to 7, the detent is a normally deactivated detent, such as the detent 39 resting on the unnotched portion 40 of the slide structure or adapter 15 when the weapon 12 is seated in its holster 14. However, such normally deactivated detent is capable of selectively retaining, or is adapted to selectively retain, the hand weapon in its holstering device. In this respect, a detent activator, such as shown at 41, is adapted to activate the detent only upon attempts to remove the hand weapon from the holstering device without the hand 51 having the outstretched finger 52, such as by prompting the detent 39 into the notch 42 when the trigger finger portion of the wearer is missing at the lever or sensor 34 in the area 36.

In this respect, FIG. 5 shows the hand 151 of an assailant whose effort to remove the weapon from the holster is frustrated by the safety mechanism 33.

Within the scope of that aspect of the invention, the holstering device 14 again may be provided with a track structure 13, and the elongate hand weapon 12 is then provided with a slide structure or adapter 15 complementary with that track structure for holstering such slide structure or adapter in the track structure while holstering the elongate hand weapon in the holstering device 14. Moreover, use of safety mechanisms according to aspects of the subject invention is not limited to specific track and slide or adapter structures.

Figure 8:
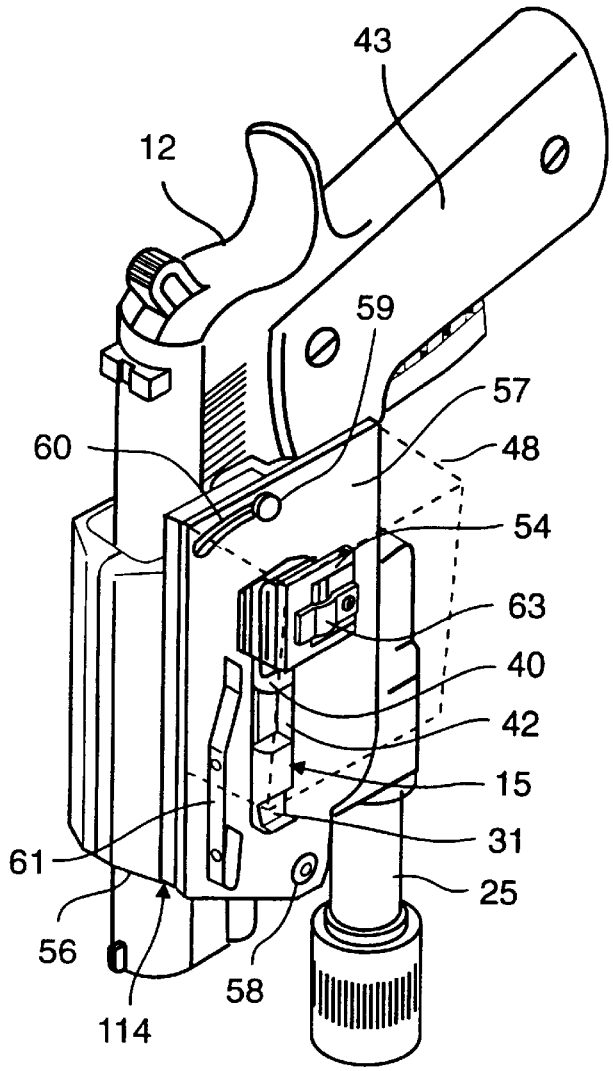
FIG. 8 is a perspective view of a holstering system according to yet another embodiment of the invention.
Figure 9:
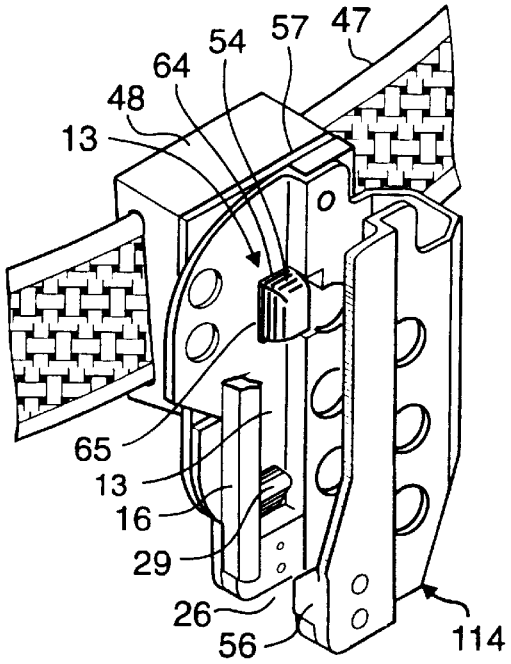
FIG. 9 is a detail view of the holstering system of FIG. 8; and in a different stage of operation.

By way of further example, such as shown in FIGS. 8 and 9, detent 54 may releasably retain or may be adapted to releasably retain the slide structure or adapter 15 at the track structure 13 until a wearer of the holstered hand weapon 12 angularly moves that hand weapon and the track structure 13.

Figure 10:
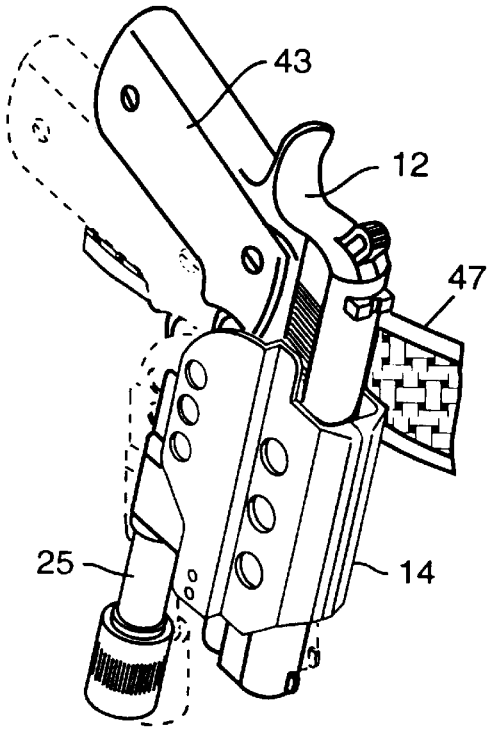
FIG. 10 is a perspective view similar to FIG. 8, but turned around showing in dotted outline a rest position of the holstering system and holstered weapon, and showing in solid outline a tilted position of weapon and holster, ready for a draw of the weapon.

According to an embodiment of the invention, the detent 54 is deactivated such as shown in FIGS. 8 to 10 by angular movement of the elongate hand weapon 12 and track structure 13.

For instance, according to the embodiment illustrated in FIGS. 8 to 10, a holstering device 114 includes an angularly moveable portion 56 and a relatively stationary portion 57. By way of example, the holster portion 56 may be pivoted at 58 on the portion 57. A slot and pin arrangement, including a pin 59 and an arcuate slot 60, may be used to limit angular movement or tilt of the hand weapon 12 and holster portion 56, from and between a rest position, such as shown in FIG. 8, in which the holster protion 56 may be held by a spring 61, to a position, such as seen in FIG. 10 in solid outline, which is fully tilted against the bias of the spring 61.

The track structure 13 is on the angularly moveable portion 57. A detent 54 is on the relatively stationary portion 57, and is positioned to engage the slide structure 15 when the hand weapon 12 is in that holstering device 114 prior to angular movement of the angularly moveable portion 56 with the hand weapon 12 relative to the stationary portion 57. The detent or latch 54 may engage the slide portion 15 of the hand weapon 12 at its notch 42, or at its upper end 115 (see FIG. 4) or in any other manner that will retain or block the weapon 12 in its holster 114 against forcible removal.

Within the scope of the invention, the slide structure 15 could simply be removed from the detent 54 as the hand weapon 12 and the track structure 13 and angularly moveable holster portion 56 which it engages are angularly moved prepratory to a draw of the hand weapon 12 from its holster 114.

However, for greater safety, the illustrated embodiment provides a detent deactivator 62 on the angularly moveable portion 56 of the holstering device 114. The detent 54 is located in a path of angular movement of such detent deactivator 59 which is on the angularly moveable portion 56. By way of example, the detent 54 may be resiliently mounted, such as by a leaf spring 63 attached to the stationary portion 57. Such resiliently mounted detent 54 may, for instance, project through an aperture 64 in the angularly moveable portion 56 to engage the slide structure 15 when the weapon 12 and its track structure 13 and angularly moveable holster portion 56 are in their rest position seen in FIG. 8 relative to FIG. 9.

The above mentioned detent deactivator 59 may, for instance, be an edge region 65 of the angularly moveable portion 56 at its aperture 64.

When the wearer of the holstered weapon 12 angularly moves the same, such as with his or her gun hand, so that the moveable holster portion 56 is angularly moved about its pivot 58, the detent deactivator edge 65 of the aperture 64 slides past the detent 54, thereby moving such detent out of the path of the angularly moving weapon 12 and slide portion 15, such as against the bias of the spring 63.

The weapon 12 may thus easily be pulled out of the holstering device with the gun hand. On the other hand, it would be difficult for an assailant to pull the weapon from the modified holster, especially since the wearer of the holstered weapon would not just stand by idly, while an assailant is working on his or her gun.

The adapter or slide structure 15 of or on the hand weapon may be universal for different types of holstering devices, such as for the holstering devices 14 and 114 shown in FIGS. 1, 2, 2A to C, 3, and 5 to 10.

An overall method according to this aspect of the invention may provide the track structure 13 and slide structure 15 with a detent 33 for releasably retaining that slide structure at that track structure against removal of the holstered hand weapon 12 from the holstering device 14. Such detent may be provided with a device 34 for sensing a presence of a part of a hand 51 of a wearer of the holstered hand weapon at a predetermined location 36 at the holstering device 14. The detent 33 may be or may remain deactivated in response to that presence of that part of said hand 51, such as of an outstretched index finger, at predetermined location 36, such as described above in conjunction with FIGS. 5 to 7.

This overall method according to the currently disclosed aspect of the invention also provides the holstering device 114 of FIGS. 8 to 10 as an alternative holstering device, and provides such alternative holstering device 114 with an alternative track structure which is complementary with the slide structure 15, and which may be similar or identical to the track structure 13, variations of which have been disclosed above. This method also provides the alternatvie holstering device 114 with an alternative detent 54 releasably retaining the slide structure 15 at the alternative track structure until a wearer of the holstered hand weapon angularly moves the hand weapon 12 and the alternative track structure 13, such as described above in conjunction with FIGS. 8 to 10 with respect to the angularly moveable holster portion 56.

An overall system as embodied in FIGS. 1, 2, 2A to C, 3, and 5 to 10 may include a detent 33 adapted to releasably retain a universal slide structure 15 at track structure 13 against removal of the holstered hand weapon 12 from holstering device 14. Such detent may include a device 34 adapted to sense a presence of a part of a hand 57 of a wearer of the holstered hand weapon at a predetermined location 36 at holstering device 44, and a device 37 with or without 40, adapted to deactivate detent 33 in response to presence of part of hand 51 at predetermined location 36. An alternative holstering device 114 for hand weapons with like slide structure 15 has an alternative track structure 13 in that alternative holstering device 114 complementary with such slide structure 14 and an alternative detent 54 adapted to releasably retain such slide structure 15 at its alternative track structure until a wearer of the holstered hand weapon angularly moves such hand weapon and the track structure 13 which at this point is designated as alternative, even though the track structure 13 of the embodiments shown in FIGS. 1, 2, 2A to C, 3, and 5 to 10 may be identical within the scope of the invention.

Hand weapon users thus are able to chose between different holstering systems.

Different people have different preferences, and the same people have different preferences for different tasks. For instance, where levers of the type shown at 37 in FIGS. 5 to 7 are disfavored, people likely would opt for the embodiment of FIGS. 8 to 10 that affords safety against violent hand weapon removal while requiring less of a conscious effort of the wearer to remove the weapon from its holster than do prior-art safety systems.

True professionals, however, likely will opt for the system exemplified in FIGS. 5 to 7, since that permits drawing of the hand weapon 12 without conscious effort as far as the detent 33 against violent removal is concerned. Especially where the detent 33 is uncocked by the upper slide portion 40 and remains uncocked during the entire draw by nothing more than the wearer's gun hand 51, the wearer does not have to do anything that he or she does not do already during the draw; namely, stretch down his or her trigger finger 52 ready for insertion into the trigger area 45 as soon as the weapon 12 is out of the holster.

The same person, police department or agency may, however, own or possess two or more of the embodiments herein disclosed, for different tasks or situations.

By way of example, the holstering device 14 may be worn on a belt 47 and, for that purpose, may be provided with or may include a belt loop structure 48 that may be attached to or integral with the holster proper. However, the part 47 also may be symbolic of waist band and shoulder straps, and the like, within the scope of the invention.

Moreover, the subject extensive disclosure will render apparent or suggest to those skilled in the art various modifications and variations within the spirit and scope of the invention.

I claim:

1. In a method of holstering an elongate hand weapon, the improvement comprising in combination:

making a track structure; forming said track structure as a holstering device for said elongate hand weapon;

equipping said elongate hand weapon with an adapter complementary with said track structure for holstering said adapter in said track structure while holstering said elongate hand weapon in said holstering device;

making said adapter integral with said elongate hand weapon as distinguished from said holstering device, so that said adapter is removed with said elongate hand weapon from said holstering device when said hand weapon is drawn from said holstering device; and equipping said holstering device and said adapter with a detent releasably retaining said adapter at said track structure.

2. A method as in claim 1, wherein:

an accessory for said hand weapon is mounted on said adapter.

3. A method as in claim 2, wherein:

said accessory is a target illumination light for said hand weapon.

4. In a method of holstering an elongate hand weapon in a holstering device having a track structure, the improvement comprising in combination:

equipping said elongate hand weapon with an adapter complementary with said track structure for holstering said adapter in said track structure while holstering said elongate hand weapon in said holstering device;

making said adapter integral with said elongate hand weapon as distinguished from said holstering device, so that said adapter is removed with said elongate hand weapon from said holstering device when said hand weapon is drawn from said holstering device; and equipping said holstering device and said adapter with a detent releasably retaining said adapter at said track structure.

5. A method as in claim 4, wherein:

said track structure is provided with two tracks in said holstering device; and said adapter is provided with two slides complementary with said two tracks.

6. A method as in claim 4, wherein:

said track structure and said adapter are shaped as a tongue and groove combination including a tongue structure as one of said track structure and said adapter, and a groove structure as the other of said track structure and said adapter.

7. A method as in claim 4, wherein:

said holstering device is open along one side thereof.

8. A method as in claim 4, including:

releasably retaining said adapter at said track structure until a wearer of the holstered hand weapon pulls said hand weapon from said holstering device.

9. A method as in claim 4, including:

manually deactivating said detent at said holstering device.

10. A method as in claim 4, including:

equipping said detent with a device for sensing a presence of a part of a hand of a wearer of the holstered hand weapon at a predetermined location at said holstering device; and deactivating said detent in response to said presence of said part of said hand at said predetermined location.

11. A method as in claim 4, wherein:

said detent is deactivated as long as said hand weapon is in said holstering device;

said detent remains deactivated by presence of part of a hand of a wearer drawing said hand weapon from said holstering device; and said detent becomes activated for retaining said hand weapon in said holstering device upon attempts to remove said hand weapon from said holstering device in the absence of said part of a hand of a wearer drawing said hand weapon.

12. A method as in claim 4, including:

releasably retaining said adapter at said track structure with said detent until a wearer of the holstered hand weapon angularly moves said hand weapon and said track structure.

13. A method as in claim 4, including:

deactivating said detent by angular movement of said elongate hand weapon and said track structure.

14. A method as in claim 4, including:

equipping said detent with a device for sensing a presence of a part of a hand of a wearer of the holstered hand weapon at a predetermined location at said holstering device;

deactivating said detent in response to said presence of said part of said hand at said predetermined location;

making an alternative holstering device;

equipping said alternative holstering device with an alternative track structure complementary with said adapter; and equipping said alternative holstering device with an alternative detent releasably retaining said adapter at said alternative track structure until a wearer of the holstered hand weapon angularly moves said hand weapon and said alternative track structure.

15. In a method of holstering an elongate hand weapon in a holstering device having a track structure, the improvement comprising:

equipping said elongate hand weapon with an adapter complementary with said track structure for holstering said adapter in said track structure while holstering said elongate hand weapon in said holstering device;

making said adapter integral with said elongate hand weapon as distinguished from said holstering device, so that said adapter is removed with said elongate hand weapon from said holstering device when said hand weapon is drawn from said holstering device;

drawing said hand weapon from said holstering device with a hand having an outstretched finger; and blocking removal of said hand weapon from said holstering device upon attempts to remove said hand weapon from said holstering device without said hand having said outstretched finger.

16. In a method of holstering any one of a number of different types of elongate hand weapons, the improvement comprising in combination:

making a standard holstering device for said different types of elongate hand weapons;

equipping each of said different types of elongate hand weapons with an adapter interfacing with said standard holstering device for said different types of elongate hand weapons;

making each adapter integral with a corresponding elongate hand weapon as distinguished from said holstering device, so that said adapter is removed with that elongate hand weapon from the holstering device when that hand weapon is drawn from the holstering device; and equipping said standard holstering device and each adapter with a detent releasably retaining each adapter.

17. In a method of holstering an elongate hand weapon; the improvement comprising in combination:

making a holstering device;

holstering said hand weapon in said holstering device;

equipping said elongate hand weapon and said holstering device with a normally deactivated detent for selectively retaining said hand weapon in said holstering device;

drawing said hand weapon from said holstering device with a hand having an outstretched finger; and blocking removal of said hand weapon from said holstering device upon attempts to remove said hand weapon from said holstering device without said hand having said outstretched finger substantially parallel to said elongate hand weapon by activating said detent only upon attempts to remove said hand weapon from said holstering device without said hand having said outstretched finger substantially parallel to said elongate hand weapon.

18. A method as in claim 17, including:

equipping said holstering device with a track structure; and equipping said elongate hand weapon with a slide structure complementary with said track structure for holstering said slide structure in said track structure while holstering said elongate hand weapon in said holstering device; and making said slide structure integral with said elongate hand weapon as distinguished from said holstering device, so that said slide structure is removed with said elongate hand weapon from said holstering device when said hand weapon is drawn from said holstering device.

19. In a method of holstering an elongate hand weapon in a holstering device having a track structure, the improvement comprising in combination:

equipping said elongate hand weapon with a slide structure complementary with said track structure for holstering said slide structure in said track structure while holstering said elongate hand weapon in said holstering device;

making said slide structure integral with said elongate hand weapon as distinguished from said holstering device, so that said slide structure is removed with said elongate hand weapon from said holstering device when said hand weapon is drawn from said holstering device;

equipping said holstering device and said slide structure with a detent for releasably retaining said slide structure at said track structure against removal of the holstered hand weapon from said holstering device;

said detent being deactivated as long as said hand weapon is in said holstering device;

said detent remaining deactivated by presence of part of a hand of a wearer drawing said hand weapon from said holstering device; and said detent becoming activated for retaining said hand weapon in said holstering device upon attempts to remove said hand weapon from said holstering device in the absence of said part of a hand of a wearer drawing said hand weapon.

20. A method as in claim 19, including:

drawing said hand weapon from said holstering device with a hand having an outstretched finger; and blocking removal of said hand weapon from said holstering device upon attempts to remove said hand weapon from said holstering device without said hand having said outstretched finger.

21. In a method of holstering an elongate hand weapon in a holstering device having a track structure, said hand weapon having an accessory exteriorily attached to a part of said hand weapon, the improvement comprising in combination:

equipping said holstering device with an accommodation for said accessory;

equipping said elongate hand weapon with an adapter complementary with said track structure for holstering said adapter in said track structure while holstering said elongate hand weapon in said holstering device; and making said adapter integral with said elongate hand weapon as distinguished from said holstering device, so that said adapter is removed with said elongate hand weapon from said holstering device when said hand weapon is drawn from said holstering device.

22. A method as in claim 21, wherein:

said adapter equipped with a mount for said accessory for said hand weapon.

23. A method as in claim 21, including:

equipping said holstering device and said adapter with a detent releasably retaining said adapter at said track structure.

24. A method as in claim 21, wherein:

said accessory for said hand weapon is attached to said adapter by a dovetail structure.

25. In a method of holstering an elongate hand weapon having an adapter for holstering said elongate hand weapon in a holstering device, and having an accessory exteriorily attached to and part of said hand weapon, the improvement comprising in combination:

equipping said holstering device with a track structure complementary with said adapter for holstering said adapter in said track structure while holstering said elongate hand weapon in said holstering device;

said adapter being integral with said elongate hand weapon as distinguished from said holstering device, so that said adapter is removed with said elongate hand weapon from said holstering device when said hand weapon is drawn from said holstering device; and equipping said holstering device with an accommodation for said accessory.

26. A method as in claim 25, wherein:

said track structure and said adapter are shaped as a tongue and groove combination including a tongue structure as one of said track structure and said adapter, and a groove structure as the other of said track structure and said adapter.

27. A method as in claim 25, wherein:

said holstering device is open along one side thereof.

28. In apparatus for holstering an elongate hand weapon, the improvement comprising in combination:

a track structure;

a holstering device for said elongate hand weapon including said track structure; and an adapter for said elongate hand weapon complementary with said track structure and removable with said elongate hand weapon from said holstering device, said adapter being integral with said elongate hand weapon as distinguished from said holstering device, so that said adapter is removed with said elongate hand weapon from said holstering device when said hand weapon is drawn from said holstering device; and a detent adapted to releasably retain said adapter at said track structure until a wearer of the holstered hand weapon pulls said hand weapon from said holstering device.

29. Apparatus as in claim 28, wherein:

said track structure includes two tracks in said holstering device; and said adapter is complementary with said two tracks in said holstering device.

30. Apparatus as in claim 28, wherein:

said track structure and said adapter comprise a tongue and groove combination including a tongue structure as one of said track structure and said adapter and a groove structure as the other of said track structure and said adapter.

31. Apparatus as in claim 28, including:

a mount for an accessory for said hand weapon on said adapter.

32. Apparatus as in claim 31, wherein:

said accessory is a target illumination light for said hand weapon.

33. In apparatus for holstering an elongate hand weapon in a holstering device including a track structure, the improvement comprising:

an adapter for said elongate hand weapon complementary with said track structure and removable with said elongate hand weapon from said holstering device, said adapter being integral with said elongate hand weapon as distinguished from said holstering device, so that said adapter is removed with said elongate hand weapon from said holstering device when said hand weapon is drawn from said holstering device; and a detent adapted to releasably retain said adapter at said track structure until a wearer of the holstered hand weapon pulls said hand weapon from said holstering device.

34. Apparatus as in claim 33, wherein:

said track structure includes two tracks in said holstering device; and said adapter is complementary with said two tracks in said holstering device.

35. Apparatus as in claim 33, wherein:

said track structure and said adapter comprise a tongue and groove combination including a tongue structure as one of said track structure and said adapter and a groove structure as the other of said track structure and said adapter.

36. Apparatus as in claim 33, including:

a manually engageable detent deactivator at said holstering device.

37. Apparatus as in claim 33, wherein:

said detent includes a device adapted to sense a presence of a part of a hand of a wearer of the holstered hand weapon at a predetermined location at said holstering device and a device adapted to deactivate said detent in response to said presence of said part of said hand at said predetermined location.

38. Apparatus as in claim 33, including:

a first detent deactivator adapted to deactivate said detent as long as said hand weapon is in said holstering device;

a second detent deactivator adapted to deactivate said detent in response to a presence of part of a hand of a wearer drawing said hand weapon from said holstering device; and a detent activator adapted to activate said detent for retaining said hand weapon in said holstering device upon attempts to remove said hand weapon from said holstering device in the absence of said part of a hand of a wearer drawing said hand weapon.

39. Apparatus as in claim 38 for a hand weapon that is drawn from said holstering device with a hand having an outstretched finger, wherein:

said detent activator includes a device adapted to block removal of said hand weapon from said holstering device upon attempts to remove said hand weapon from said holstering device without said hand having said outstretched finger.

40. Apparatus as in claim 33, including:

said detent adapted to releasably retain said adapter at said track structure until a wearer of the holstered hand weapon angularly moves said hand weapon and said track structure.

41. Apparatus as in claim 33, wherein:

said holstering device includes an angularly moveable portion and a relatively stationary portion;

said track structure on said angularly moveable portion; and said detent on said relatively stationary portion positioned to engage said adapter when said hand weapon is in said holstering device prior to angular movement of said angularly moveable portion relative to said stationary portion.

42. Apparatus as in claim 33, wherein:

said holstering device includes an angularly moveable portion and a relatively stationary portion;

said track structure is on said angularly moveable portion;

said detent is on said relatively stationary portion positioned to engage said adapter when said hand weapon is in said holstering device; and a detent deactivator on said angularly moveable portion of said holstering device;

said detent located in a path of angular movement of said detent deactivator on said angularly moveable portion.

43. Apparatus as in claim 33, wherein:

said detent includes a device adapted to sense a presence of a part of a hand of a wearer of the holstered hand weapon at a predetermined location at said holstering device and a device adapted to deactivate said detent in response to said presence of said part of said hand at said predetermined location; and said apparatus includes:

an alternative holstering device;

an alternative track structure in said alternative holstering device complementary with said adapter; and an alternative detent adapted to releasably retain said adapter at said alternative track structure until a wearer of the holstered hand weapon angularly moves said hand weapon and said alternative track structure.

44. In apparatus for holstering an elongate hand weapon having an adapter for said elongate hand weapon, the improvement comprising in combination:

a track structure complementary with said adapter;

a holstering device for said elongate hand weapon including said track structure;

said adapter removable with said elongate hand weapon from said holstering device, said adapter being integral with said elongate hand weapon as distinguished from said holstering device, so that said adapter is removed with said elongate hand weapon from said holstering device when said hand weapon is drawn from said holstering device; and a detent adapted to releasably retain said adapter at said track structure until a wearer of the holstered hand weapon pulls said hand weapon from said holstering device.

45. Apparatus as in claim 44, wherein:

said track structure includes two tracks in said holstering device; and said adapter includes two slides complementary with said two tracks in said holstering device.

46. Apparatus as in claim 44, wherein:

said track structure and said adapter comprise a tongue and groove combination including a tongue structure as one of said track structure and said adapter and a groove structure as the other of said track structure and said adapter.

47. In apparatus for holstering any one of a number of different types of elongate hand weapons, the improvement comprising in combination:

a standard holstering device for said different types of elongate hand weapons;

for each of said different types of elongate hand weapons an adapter interfacing with said standard holstering device for said different types of elongate hand weapons and removable with the elongate hand weapon from said holstering device, each adapter being integral with a corresponding elongate hand weapon as distinguished from said holstering device, so that that adapter is removed with that elongate hand weapon from said holstering device when that hand weapon is drawn from said holstering device;

a track structure in said standard holstering device;

each adapter being complementary with said track structure in said standard holstering device; and a detent adapted to releasably retain said adapter at said track structure until a wearer of the holstered hand weapon pulls said hand weapon from said holstering device.

48. Apparatus as in claim 47, wherein:

said track structure includes two tracks in said holstering device;

said adapter being complementary with said two tracks in said holstering device.

49. Apparatus as in claim 47, wherein:

said track structure and said adapter comprise a tongue and groove combination including a tongue structure as one of said track structure and said adapter and a groove structure as the other of said track structure and said adapter.

50. Apparatus as in claim 47, including:

a manually engageable detent deactivator at said holstering device.

51. Apparatus as in claim 47, including:

said detent including a device adapted to sense a presence of a part of a hand of a wearer of the holstered hand weapon at a predetermined location at said holstering device and a device adapted to deactivate said detent in response to said presence of said part of said hand at said predetermined location.

52. Apparatus as in claim 47, including:

a first detent deactivator adapted to deactivate said detent as long as said hand weapon is in said holstering device;

a second detent deactivator adapted to deactivate said detent in response to a presence of part of a hand of a wearer drawing said hand weapon from said holstering device; and a detent activator adapted to activate said detent for retaining said hand weapon in said holstering device upon attempts to remove said hand weapon from said holstering device in the absence of said part of a hand of a wearer drawing said hand weapon.

53. Apparatus as in claim 52 for a hand weapon that is drawn from said holstering device with a hand having an outstretched finger, wherein:

said detent activator includes a device adapted to block removal of said hand weapon from said holstering device upon attempts to remove said hand weapon from said holstering device without said hand having said outstretched finger.

54. Apparatus as in claim 47, including:

said detent adapted to releasably retain said adapter at said track structure until a wearer of the holstered hand weapon angularly moves said hand weapon and said track structure.

55. Apparatus as in claim 47, wherein:

said holstering device includes an angularly moveable portion and a relatively stationary portion;

said track structure on said angularly moveable portion; and said detent is on said relatively stationary portion positioned to engage said adapter when said hand weapon is in said holstering device prior to angular movement of said angularly moveable portion relative to said stationary portion.

56. Apparatus as in claim 47, wherein:

said holstering device includes an angularly moveable portion and a relatively stationary portion;

said track structure on said angularly moveable portion;

said detent is on said relatively stationary portion positioned to engage said adapter when said hand weapon is in said holstering device; and a detent deactivator is on said angularly moveable portion of said holstering device;

said detent located in a path of angular movement of said detent deactivator on said angularly moveable portion.

57. Apparatus as in claim 47, including:

said detent adapted to releasably retain said adapter at said track structure against removal of the holstered hand weapon from said holstering device;

said detent including a device adapted to sense a presence of a part of a hand of a wearer of the holstered hand weapon at a predetermined location at said holstering device and a device adapted to deactivate said detent in response to said presence of said part of said hand at said predetermined location;

an alternative holstering device;

an alternative track structure in said alternative holstering device complementary with said adapter; and an alternative detent adapted to releasably retain said adapter at said alternative track structure until a wearer of the holstered hand weapon angularly moves said hand weapon and said alternative track structure.

58. In apparatus for holstering an elongate hand weapon, the improvement comprising in combination:

a holstering device for said hand weapon;

a normally deactivated detent adapted to block removal of said hand weapon from said holstering device by selectively retaining said hand weapon in said holstering device; and a detent activator adapted to activate said detent only upon attempts to remove said hand weapon from said holstering device without a hand having a finger outstretched substantially parallel to said elongate hand weapon.

59. In apparatus for holstering an elongate hand weapon, the improvement comprising in combination:

a holstering device for said hand weapon;

a track structure in said holstering device for said elongate hand weapon;

an adapter for said elongate hand weapon complementary with said track structure and removable with said elongate hand weapon from said holstering device, said adapter being integral with said elongate hand weapon as distinguished from said holstering device, so that said adapter is removed with said elongate hand weapon from said holstering device when said hand weapon is drawn from said holstering device; and a detent adapted to block removal of said hand weapon from said holstering device upon attempts to remove said hand weapon from said holstering device without a hand having a finger outstretched substantially parallel to said elongate hand weapon.

60. Apparatus as in claim 59, wherein:

said track structure includes two tracks in said holstering device; and said adapter is complementary with said two tracks in said holstering device.

61. Apparatus as in claim 59, wherein:

said track structure and said adapter comprise a tongue and groove combination including a tongue structure as one of said track structure and said adapter and a groove structure as the other of said track structure and said adapter.

62. In apparatus for holstering an elongate hand weapon in a holstering device including a track structure, the improvement comprising in combination:

a slide structure for said elongate hand weapon complementary with said track structure and removable with said elongate hand weapon from said holstering device, said slide structure being integral with said elongate hand weapon as distinguished from said holstering device, so that said slide structure is removed with said elongate hand weapon from said holstering device when said hand weapon is drawn from said holstering device;

a detent adapted to releasably retain said slide structure at said track structure against removal of the holstered hand weapon from said holstering device;

a first detent deactivator adapted to deactivate said detent as long as said hand weapon is in said holstering device;

a second detent deactivator adapted to deactivate said detent in response to a presence of part of a hand of a wearer drawing said hand weapon from said holstering device; and a detent activator adapted to activate said detent for retaining said hand weapon in said holstering device upon attempts to remove said hand weapon from said holstering device in the absence of said part of a hand of a wearer drawing said hand weapon.

63. In apparatus for holstering an elongate hand weapon in a holstering device including a track structure, the improvement comprising in combination:

a slide structure for said elongate hand weapon complementary with said track structure and removable with said elongate hand weapon from said holstering device, said slide structure being integral with said elongate hand weapon as distinguished from said holstering device, so that said slide structure is removed with said elongate hand weapon from said holstering device when said hand weapon is drawn from said holstering device;

said holstering device including an angularly moveable portion and a relatively stationary portion;

said track structure being on said angularly moveable portion; and a detent on said relatively stationary portion positioned to engage said slide structure when said hand weapon is in said holstering device prior to angular movement of said angularly moveable portion relative to said stationary portion.

64. Apparatus as in claim 63, including:

a detent deactivator on said angularly moveable portion of said holstering device;

said detent located in a path of angular movement of said detent deactivator on said angularly moveable portion.

65. In apparatus for holstering an elongate hand weapon in a holstering device including a track structure, said hand weapon having an exterior accessory, the improvement comprising:

an adapter for said elongate hand weapon complementary with said track structure and removable with said elongate hand weapon from said holstering device, said adapter being integral with said elongate hand weapon as distinguished from said holstering device, so that said adapter is removed with said elongate hand weapon from said holstering device when said hand weapon is drawn from said holstering device;

said holstering device including an accommodation for said accessory.

66. Apparatus as in claim 65, wherein:

said holstering device is open along one side thereof.

67. Apparatus as in claim 65, wherein:

said adapter has a mount for said accessory for said hand weapon.

68. Apparatus as in claim 65, including:

a detent adapted to releasably retain said adapter at said track structure.

69. Apparatus as in claim 65, a detent adapted to releasably retain said adapter at said track structure until a wearer of the holstered hand weapon pulls said hand weapon from said holstering device.

70. Apparatus as in claim 65, including:

a dovetail structure between said accessory and said adapter.

* * * * *